US010968579B2

(12) United States Patent
Brophy et al.

(10) Patent No.: US 10,968,579 B2
(45) Date of Patent: Apr. 6, 2021

(54) AVALANCHE CONTROL DEVICE

(71) Applicant: Avy Blasters, LLC, Mill Valley, CA (US)

(72) Inventors: Christopher Brophy, Pacific Grove, CA (US); Evan Neumann, Mill Valley, CA (US)

(73) Assignee: Avy Blasters, LLC, Mill Valley, CA (US)

( * ) Notice: Subject to any disclaimer, the term of this patent is extended or adjusted under 35 U.S.C. 154(b) by 0 days.

(21) Appl. No.: 16/521,681

(22) Filed: Jul. 25, 2019

(65) Prior Publication Data

US 2020/0032466 A1 Jan. 30, 2020

Related U.S. Application Data

(60) Provisional application No. 62/703,473, filed on Jul. 26, 2018.

(51) Int. Cl.
*E01F 7/04* (2006.01)
*F42D 5/05* (2006.01)

(52) U.S. Cl.
CPC . *E01F 7/04* (2013.01); *F42D 5/05* (2013.01)

(58) Field of Classification Search
CPC ..... E01F 7/00; E01F 7/04; E01F 7/045; F42B 3/087; F42B 12/204; F42D 3/00; F42D 5/05
See application file for complete search history.

(56) References Cited

U.S. PATENT DOCUMENTS 5,107,765 A * 4/1992 Schippers ..... G10K 15/043 102/301
6,324,982 B1 * 12/2001 Eybert-Berard ..... F42D 3/00 102/363
2004/0164285 A1 * 8/2004 Bernasconi ..... E01F 7/04 256/12.5
2006/0254449 A1 * 11/2006 Hisel ..... F41H 9/04 102/302
2009/0241794 A1 * 10/2009 Eggers ..... A01M 29/20 102/302

FOREIGN PATENT DOCUMENTS

CA 2929500 A1 * 5/2015 ..... F42B 3/087

* cited by examiner

*Primary Examiner* — Stephen Johnson
(74) *Attorney, Agent, or Firm* — George R. McGuire; Bond Schoeneck & King

(57) ABSTRACT

An avalanche control device includes a detonation initiator unit and a bio-degradable linear bag. The initiator unit is elongated and includes an ignition end, an inflation end, and a stepped transition zone in between that gets progressively greater in diameter as it extends from the ignition end towards the inflation end. The inflatable bag is adapted for connection to the inflation end of the initiator unit. The design of initiator unit is fixed and reusable, while the bag dimensions can be tailored to the desired blast strength for the end user, in terms of length, diameter, and mixture ratio.

5 Claims, 2 Drawing Sheets

Bag Stored Configuration

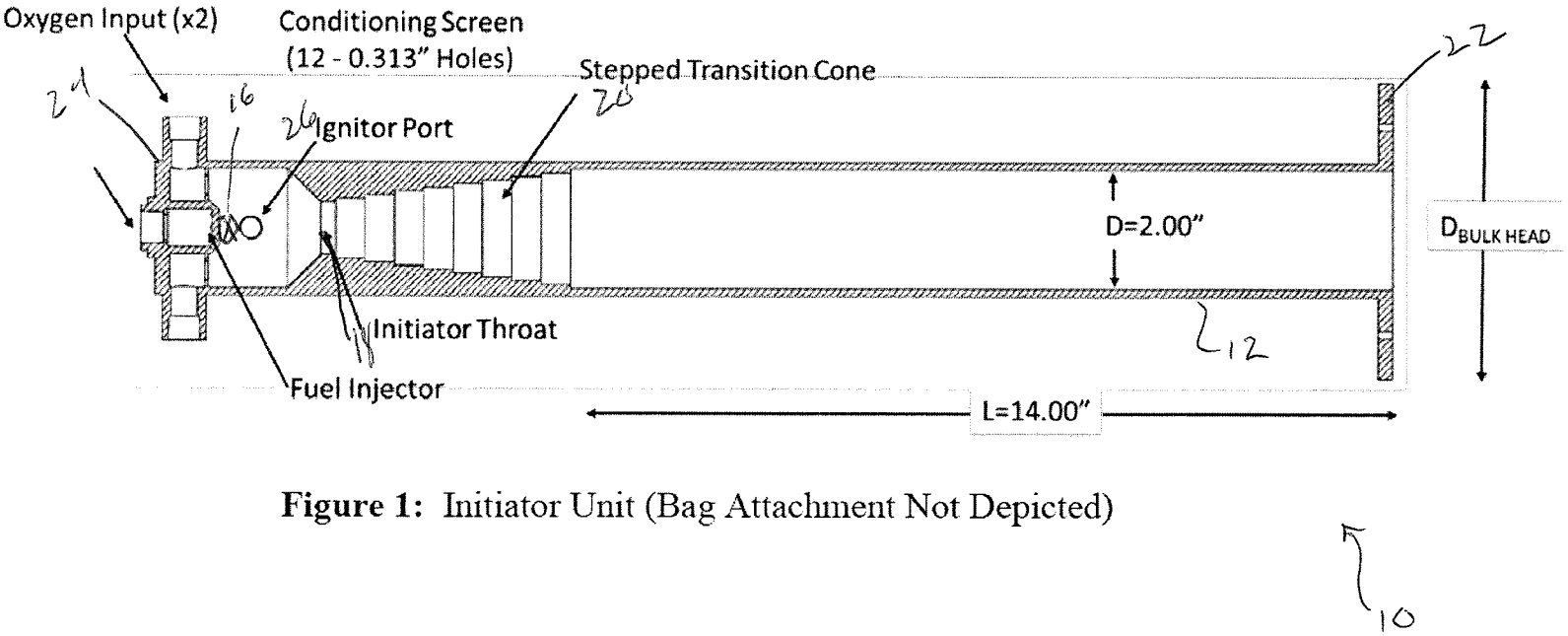
Figure 1: Initiator Unit (Bag Attachment Not Depicted)

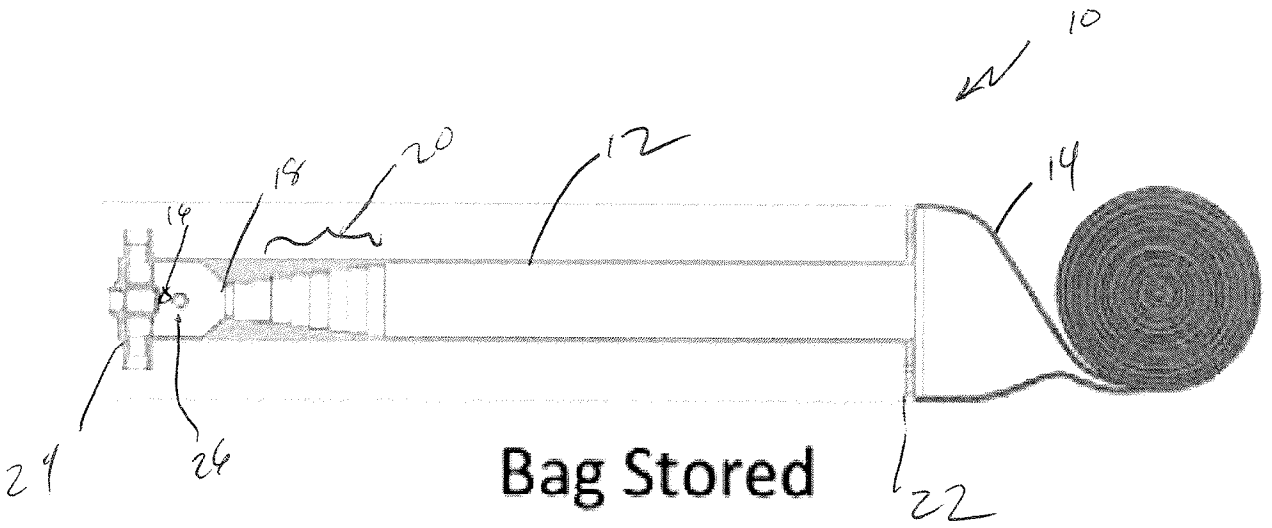
FIG. 2 Bag Stored Configuration
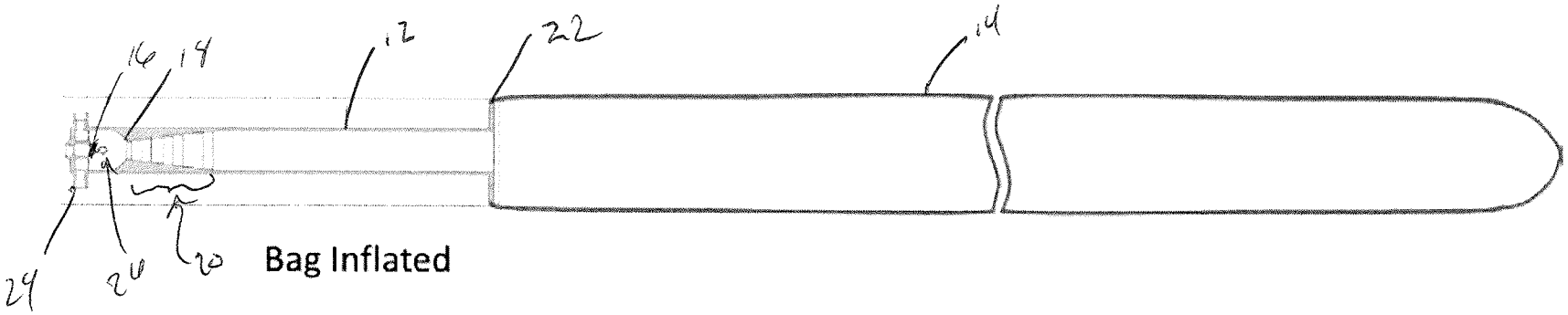
FIG. 3 Bag Inflated Configuration

AVALANCHE CONTROL DEVICE

CROSS-REFERENCE TO RELATED APPLICATION

The present application relates and claims priority to U.S. Provisional Application, Ser. No. 62/703,473, filed Jul. 26, 2018, the entirety of which is hereby incorporated by reference.

BACKGROUND

The need to safely manage and treat avalanche-prone areas at ski-resorts and back country areas continues to be challenging due to the unique terrain, weather conditions, and accessibility at each location. Avalanches are often triggered accidently by enthusiastic skier and snowboarders who desire access to undisturbed snow and aggressive terrain features. Unfortunately, when left untreated, many of these areas result in avalanches which kill numbers of outdoor enthusiasts per year.

The option to selectively promote avalanches is the preferred method to stabilize the snowpack on hillsides so that only skilled technicians are present when the avalanches are generated and therefore minimize the chances for any collateral damage due to the unpredictability of the magnitude of the event. This is often achieved by generating large overpressures through explosives, some of which are thrown by ski patrol members and sometimes result in loss of life. The desire to precisely and safely deploy a portable avalanche control device would be one valuable tool for ski patrol and other professionals to have access to. Thereby, removing the need to carry and throw high-explosives, use large caliber guns from remote sites, and operate helicopters under non-ideal flight conditions.

Avalanche control has historically been managed and initiated with three approaches. The first involves ground-based large-caliber guns which launch explosive shells at the mountain side. The maintenance and operation of these guns involve high costs and the risk of unexploded ordinances is always a possibility. The second option that some resorts use is the ability to drop explosives out of a helicopter over areas of concern which can be very costly and inherently has flight risks as well as the risk of lighting fuses within the helicopter. The last approach is to utilize high explosives, such as dynamite, to initiate local air blasts above the avalanche prone area. This would involve transporting the explosive to the region of interests, lighting a fuse, and throwing the explosive charge. Obviously, this approach carries similar or greater risks as the approach of dropping explosive charges from a helicopter.

All of the approaches described, have the explosive mixture inherently mixed and ready to be initiated which is always a safety concern. The primary difference is the selectivity of each method and the manner in which the explosive is transported and initiated. If successful, the resulting overpressure from the blast wave destabilizes the snowpack resulting in a cascade effect down the mountainside and thereby generating an avalanche Accordingly, there is a continued need in the art for an avalanche control device wherein the explosive materials are separated and mixed only when needed.

BRIEF DESCRIPTION OF THE DRAWINGS

The present invention will be more fully understood and appreciated by reading the following Detailed Description of the Invention in conjunction with the accompanying drawings in which:

FIG. 1 is a side cross-sectional view schematic representation of an initiator unit (inflatable bag not depicted), in accordance with an embodiment.

FIG. 2 is a side view schematic representation of an initiator unit with the inflatable bag in the stored configuration, in accordance with an embodiment.

FIG. 3 is a side view schematic representation of an initiator unit with the inflatable bag in the inflated configuration, in accordance with an embodiment.

SUMMARY OF THE INVENTION

The present disclosure is directed to an avalanche control device.

According to an aspect is an avalanche control device, comprising an initiator unit body. The initiator unit body comprises an ignition end and an inflation end; an oxygen input and a fuel injector at the ignition end; an ignitor port indirectly connected to the oxygen input and the fuel injector via the initiator unit body; and a tapered portion extending between the ignitor port and the inflation end. The device also includes an inflatable bag adapted for attachment to the inflation end of the initiator unit body, wherein the bag attachment is movable between a stored configuration and an inflated configuration.

According to an embodiment the tapered portion comprises a series of steps that get increasingly larger in diameter as it extends from the ignition end towards the inflation end.

According to an embodiment, the initiator unit body further comprises a converging throat positioned between the ignition end and the tapered portion.

According to an embodiment, the inflatable bag is biodegradable.

According to an embodiment, the inflation end terminates in a bulkhead.

According to an aspect, a method for controlling an avalanche in a blast zone, comprising the steps of providing an elongated initiator unit body having an ignition end and a inflation end and a stepped transition zone that increases in diameter as it extends from the ignition end towards the inflation end; attaching an inflatable bag to the inflation end of an initiator unit body; orienting the initiation unit body such that it extends from the ignition end towards the inflation end in a direction towards the blast zone; deploying the inflatable bag over the blast zone; attaching a source of oxygen and a source of fuel to the ignition end of an elongated initiator unit; closing the supply valve to the ignition unit; and remotely igniting the oxygen and fuel mixture to create a detonation wave within the initiator unit body.

These and other aspects of the invention will be apparent from the embodiments described below.

DETAILED DESCRIPTION OF EMBODIMENTS

An avalanche control device, designated generally by reference numeral 10, comprises an elongated detonation initiator unit 12 having a particular geometry described hereinafter and a bio-degradable linear bag 14. Although the design of initiator unit 12 is fixed and reusable, the linear bag 14 dimensions can be tailored to the desired blast strength for the end user, in terms of length, diameter, and mixture ratio. The initiator unit 12 functions by rapidly mixing a fuel/oxidizer blend (not shown) which is delivered to the bag 14 by passing through the initiator unit 12. Once the bag 14 is inflated, the supply valves 16 are closed and the ignition event occurs. Due to the local restriction 18 at the head-end of the initiator unit 14 (e.g., throat) and the series of turbulence generating steps 20 (e.g., narrowing tapered stepped transition zone that increase in diameter as it extends from the ignition end towards the inflation end) after the throat 18, a rapid deflagration-to-detonation transition process occurs and a detonation wave will form. After the detonation wave forms and exits the initiator unit 12 at the aft bulk head 22, the geometry and mixtures used will support the diffraction of the detonation wave around the corner and successfully transmits the detonation wave into the bag mixture as a self-supporting wave. The resulting local overpressures will be approximately 300-400 psi immediately behind the detonation wave and decay rapidly to lower values as the wave spreads cylindrically. The overpressure values should be sufficient to trigger an avalanche if the snowpack structure is inherently unstable.

The two reactants are safely transported to the area of concern since they are stable until dynamically mixed. The system is deployed by placing the initiator tube 12 on the snow pack and directed towards the area of concern. The linear bag 14 is then deployed across the desired blast zone which can be accomplished via a harpoon like system, quadcopter, or unrolled during the fill process much like a party streamer would unfurl. In either case, once the plastic bag 14 is connected to the initiator unit 12, the fuel and oxidizer supply lines (not shown) may be connected to the manifold valves 24. The remote control box is connected to initiator controller through a cable and located approximately 400' from the initiator unit. After it is verified that the firing officer possesses the safety key, the ignitor may be connected to the ignitor port 26, the supply gases are opened, and all personnel evacuated to the remote control box location. The officer may then insert the key, arm the system, and proceed with a fill and detonate sequence.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto; inventive embodiments may be practiced otherwise than as specifically described and claimed.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalents.

What is claimed is:

1. An avalanche control device, comprising:

a. initiator unit body comprising:
   i. an ignition end and an inflation end;
   ii. an oxygen input and a fuel injector at the ignition end;
   iii. an ignitor port indirectly connected to the oxygen input and the fuel injector via the initiator unit body; and
   iv. a tapered portion extending between the ignitor port and the inflation end; and b. an inflatable bag adapted for attachment to the inflation end of the initiator unit body, wherein the bag attachment is movable between a stored configuration and an inflated configuration.

2. The avalanche control device according to claim 1, wherein the tapered portion comprises a series of steps that get increasingly larger in diameter as the tapered portion extends from the ignition end towards the inflation end.

3. The avalanche control device according to claim 1, wherein the initiator unit body further comprises a converging throat positioned between the ignition end and the tapered portion.

4. The avalanche control device according to claim 1, wherein the inflatable bag is biodegradable.

5. The avalanche control device according to claim 1, wherein the inflation end terminates in a bulkhead.

* * * * *